US005145031A

United States Patent [19]

Sprunger

[11] Patent Number: 5,145,031

[45] Date of Patent: Sep. 8, 1992

[54] ELECTRIC LADDER

[76] Inventor: Powell L. Sprunger, 63 Gaslight La., Easton, Mass. 02334

[21] Appl. No.: 586,935

[22] Filed: Sep. 24, 1990

[51] Int. Cl.[5] ..... E06C 7/12

[52] U.S. Cl. ..... 182/141; 182/194; 182/228; 182/103

[58] Field of Search ..... 182/141, 148, 194, 63, 182/228, 166, 103

[56] References Cited

U.S. PATENT DOCUMENTS

| | | | |
|---|---|---|---|
| 2,880,920 | 4/1959 | Glessner | 182/166 |
| 3,088,123 | 5/1963 | Loughridge | 182/148 |
| 3,196,981 | 7/1965 | Winnall | 182/148 |
| 3,799,289 | 3/1974 | Cecere | 182/148 |
| 4,049,081 | 9/1977 | McDonald | 182/148 |
| 4,427,094 | 1/1984 | Winkelblech | 182/148 |

*Primary Examiner*—Reinaldo P. Machado
*Attorney, Agent, or Firm*—Powell L. Sprunger

[57] ABSTRACT

An adjustable ladder comprising, a pair of side supports, a device for retaining the supports in a spaced relationship, a rung, a device for slidably mounting the rungs in the supports, and a device for moving the rung along the supports for adjusting the position of the rung.

12 Claims, 4 Drawing Sheets

ELECTRIC LADDER

BACKGROUND OF THE INVENTION

The present invention relates to ladders.

In the past, ladders of various kinds have been known. Such ladders have a plurality of rungs secured at a fixed position in a pair of side supports. Although useful in climbing to a higher elevation, such ladders pose a danger during climbing of the rungs. In addition, these ladders require energy of the user in repeatedly climbing up and down on the ladder, and also only permit fixed elevations on the ladder.

SUMMARY OF THE INVENTION

A principal feature of the present invention is the provision of an improved ladder of simplified construction.

The ladder of the present invention comprises, a pair of side supports, means for retaining the supports in a spaced relationship, and means for slidably mounting the rung in the supports.

A feature of the present invention is the provision of means for moving the rung along the supports.

Another feature of the invention is that the elevation of the rung is adjustable.

Yet another feature of the invention is that the ladder eliminates the necessity of climbing the ladder.

A further feature of the invention is that the ladder minimizes the possibility of harm to the user.

Further features of the present invention will become more fully apparent in the following description of the embodiments of the this invention and from the appended claims.

Figure 1:
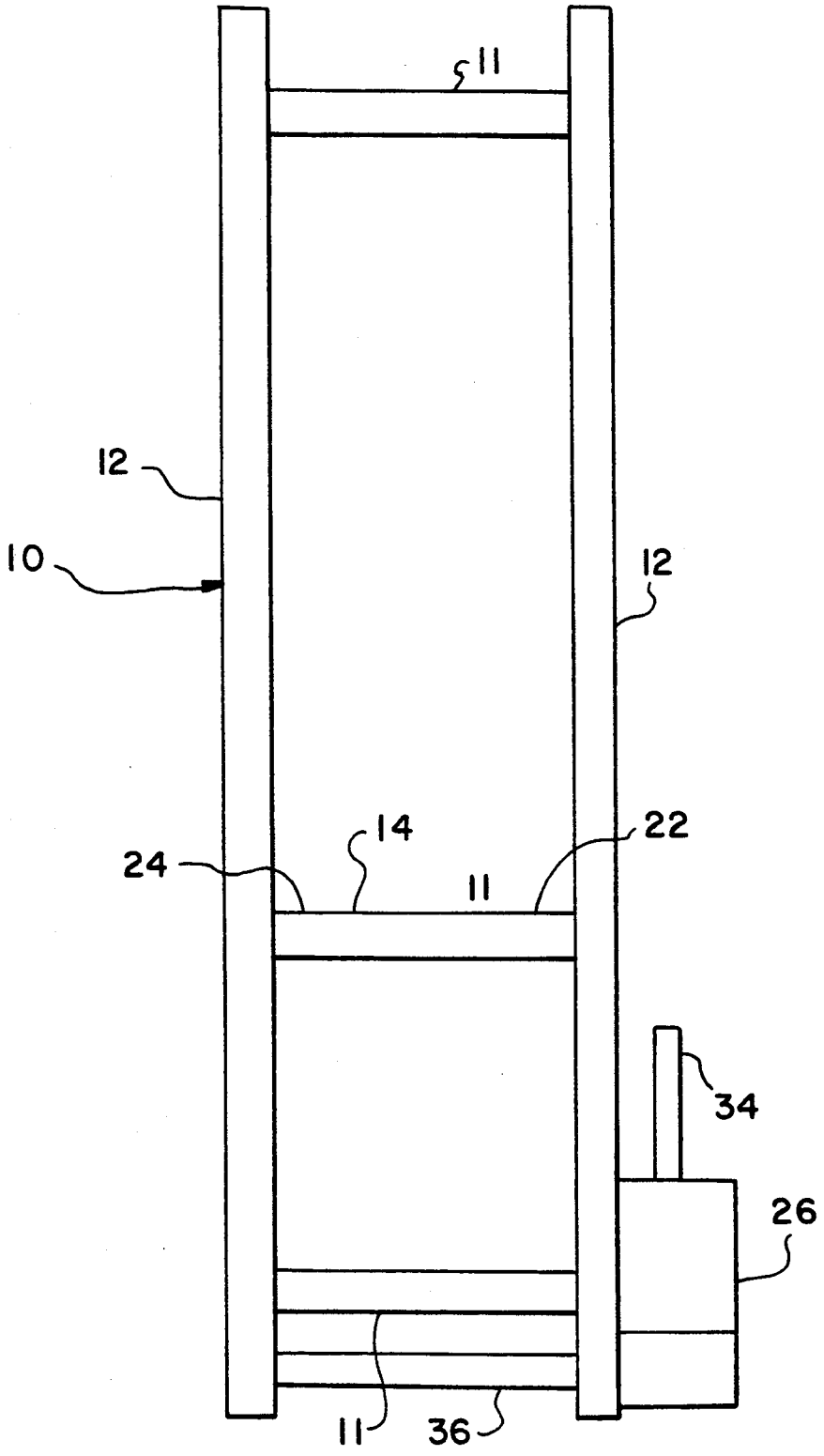
FIG. 1 is a plan view of a ladder of the present invention.
Figure 3:
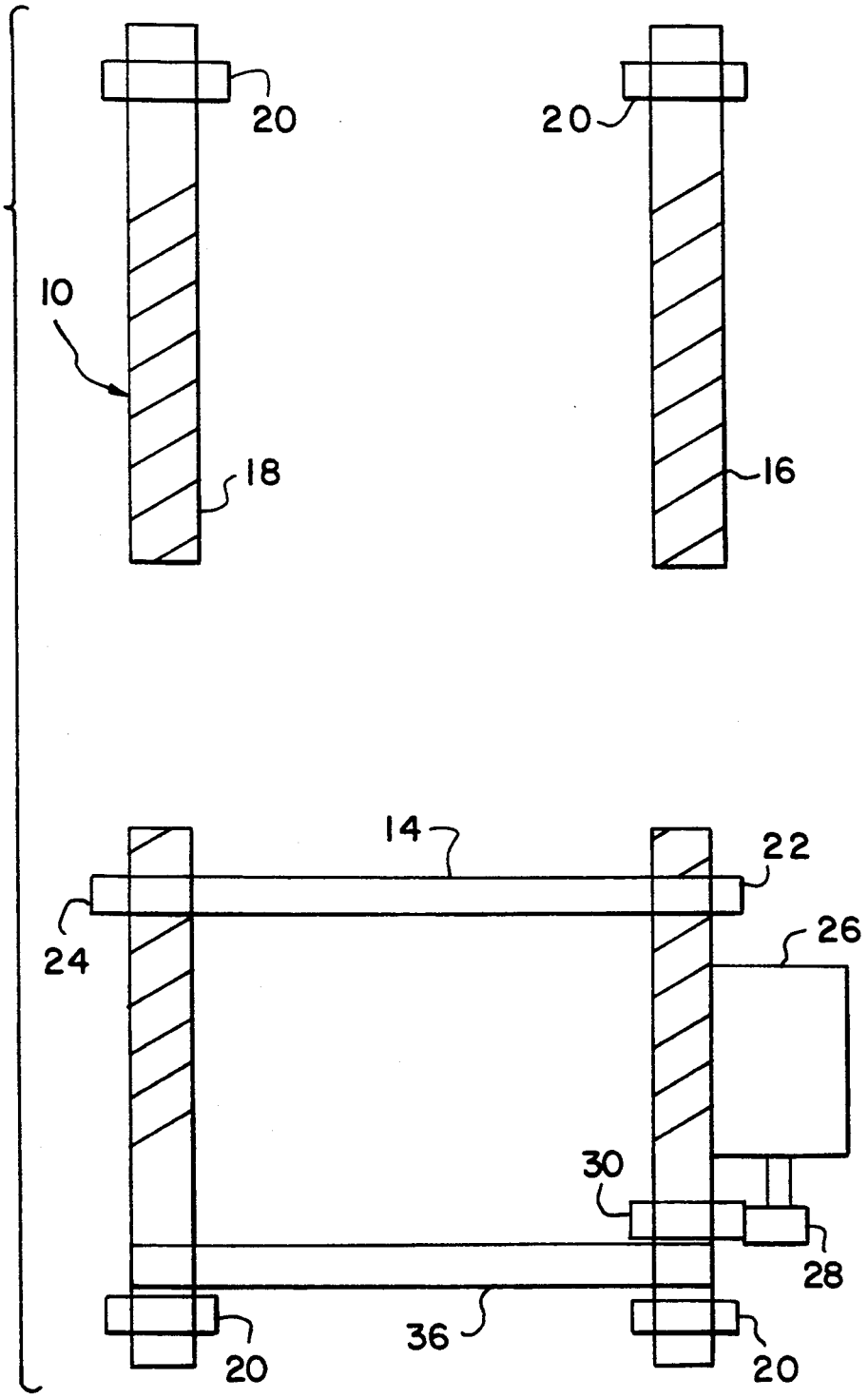

Fig, 2 is a side elevational view of the ladder of FIG. 1;

FIG. 3 is a sectional view of the ladder of FIG. 1; and

Figure 4:
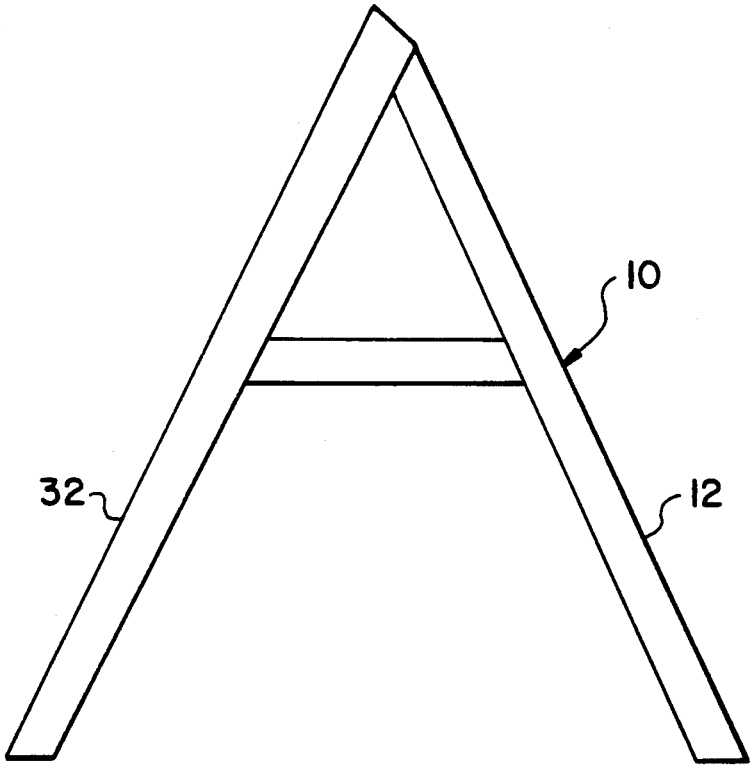

FIG. 4 is a side fragmentary elevational view another embodiment of the ladder of the present invention.

DESCRIPTION OF THE PREFERRED EMBODIMENTS

Figure 2:
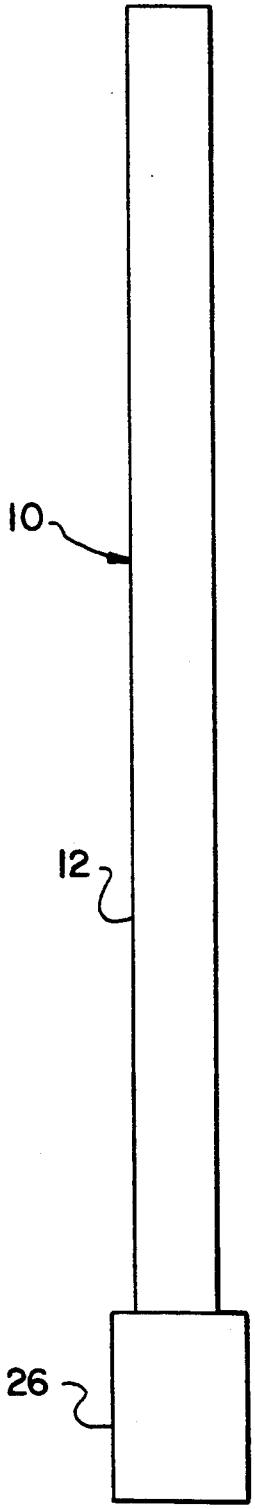

Referring now to FIGS. 1-3, there is shown an adjustable ladder generally designated 10 of the present invention. The ladder 10 has a pair of side supports 12 and a pair of bars 11 extending between the supports 12 adjacent opposed ends of the ladder. Additional retaining members may be placed between the supports 12, if desired. The ladder 10 has a rung 14 extending between the supports 12.

The ladder 10 has a pair of threaded screws 16 and 18 extending along the supports 12, and the screws 16 and 18 are mounted by bearings 20 adjacent opposed ends of the supports 12 to permit rotational movement of the screws 16 and 18 in the ladder 10. The rung 14 has a pair of threaded oppose ends 22 and 24, respectively, with the ends 22 and 24 received on the screws 16 and 18, such that rotational movement of the screws 16 and 18 imparts longitudinal movement of the rung 14 along the supports 12 in opposite directions depending on the direction of rotation of the screws 16 and 18.

The ladder 10 has a suitable motor 26, such as a servo motor, energized by a source of electrical energy through a suitable electrical cord 34 and mounted on one of the supports 12, and a driven gear 28 meshed with a gear 30 mounted on the screw 16, such that the motor 26 drives the screw 16 through the gears 28 and 30. Thus, actuation of the motor 26 causes longitudinal movement of the rung 14 along the supports 12. Although the actuation of the ladder is preferably through the use of electrical energy, it is also contemplated that the ladder may be actuated by other suitable means, such as hydraulics. Also, in a preferred form, the other screw 18 is rotated through a rotatable mounted shaft 36 which is meshed by suitable gears on the screws 16 and 18 in order that rotational movement of the screw 16 is imparted as rotational movement to the screw 18 in the same rotational direction for maximum efficiency in driving the rung 14 along the supports 12.

In this manner, the rung 14 is moved along the supports 12 of the ladder 10 in order to adjust the position of the rung 14 along the supports 12. Also, the ladder 10 eliminates the necessity of climbing the ladder.

Another embodiment of the present invention is illustrated in FIG. 4. In this embodiment, the ladder 10 comprises a step ladder in which the main support 12 for the ladder comprises the ladder 10 with movable rung 14, as previously described. The ladder 10 of FIG. 4 also has an auxiliary support 32 extending from an upper end of the main support members 12. The ladder 10 of FIG. 4 in other respects operates in a manner as previously described in connection with FIGS. 1-3.

The foregoing detailed description is given for clearness of understanding only, as modifications will be obvious to those skilled in the art.

What is claimed is:

1. An adjustable ladder, comprising:

a pair of spaced side supports;

means for retaining the supports in a spaced relationship; a rung;

means for slidably mounting the rung in the supports;

means on said side supports for moving the rung along the supports for adjusting the position of the rung; and said means laterally stabilizing the rung for positive control of the rung during both upward and downward movement of the rung by the moving means.

2. The ladder of claim 1 wherein the stabilizing means comprises a pair of elongated spaced rotatable screws extending along said supports.

3. The ladder of claim 2 wherein the moving means comprises at least one motor connected to at least one of the screws.

4. The ladder of claim 3 wherein the motor is connected to both of said screws, and including means for synchronizing rotation of both screws by the motor.

5. The ladder of claim 2 wherein the driving means comprises a motor, and including at least one gear connecting the motor to at least one screw.

6. The ladder of claim 5 including at least one additional gear connecting the motor to the other screw.

7. The ladder of claim 2 including means for synchronizing rotation of both of said screws.

8. The ladder of claim 1 wherein the ladder comprises a step ladder, and wherein the ladder has at least one auxiliary support extending from an upper end of the main supports.

9. The ladder of claim 2 wherein the rung has a pair of threaded bores located adjacent opposed ends of the rung and being received on the threaded screws, such that rotational movement of the screws imparts a linear motion of the rung along the supports.

10. The ladder of claim 1 wherein the stabilizing means stabilizes the rung against tilting during upward and downward movement of the rung.

11. The ladder of claim 1 wherein the stabilizing means provides positive movement of the rung in both upward and downward movement of the rung by the moving means.

12. The ladder of claim 2 including means for rotatably retaining the screws along the supports, and in which the moving means comprises means for rotating the screws.

* * * * *